United States Patent [19]

Litzinger

[11] Patent Number: 4,924,886

[45] Date of Patent: May 15, 1990

[54] SMOKING ARTICLE

[75] Inventor: Elmer F. Litzinger, Louisville, Ky.

[73] Assignee: Brown & Williamson Tobacco Corporation, Louisville, Ky.

[21] Appl. No.: 273,775

[22] Filed: Nov. 21, 1988

[51] Int. Cl.[5] ..... A24D 3/04

[52] U.S. Cl. ..... 131/194; 131/361; 131/363; 131/364

[58] Field of Search ..... 131/361, 363, 364, 359, 131/369, 198.1, 198.2, 194, 196

[56] References Cited

U.S. PATENT DOCUMENTS 3,774,622 11/1973 Steigerwald ..... 131/198.2

4,474,191 10/1984 Steiner ..... 131/198.2

*Primary Examiner*—V. Millin

*Attorney, Agent, or Firm*—Charles G. Lamb

[57] ABSTRACT

A smoking device includes a tobacco column having a wrapper and either a mouthpiece or filter rod located coaxially at one end of the tobacco column. A rigid tube is concentrically located in the tobacco column. A substrate of porous material is located within the tube. A flavor releasing material and an aerosol generating material are also disposed within the tube. A smoke impermeable seal is located at the interface of the tobacco column and the mouthpiece/filter.

13 Claims, 2 Drawing Sheets

SMOKING ARTICLE

BACKGROUND OF THE INVENTION

The present invention relates to smoking devices, and more particularly, to a smoking article which includes flavor releasing material and aerosol generating material which are volatilized by the heat generated by burning tobacco, but are not directly subjected to the burning tobacco.

Smoking articles having a tobacco column with a tubular member therethrough, wherein the tube is filled with an aerosol releasing material, are known. The following patents illustrate various known smoking articles of this type: U.S. Pat. No. 3,258,015 issued on June 28, 1966 to C. D. Ellis, et al.; U.S. Pat. No. 3,356,094 issued on Dec. 5, 1967 to C. D. Ellis, et al.; U.S. Pat. No. 4,340,072 issued on July 20, 1982 to Bolt, et al.; U.S. Pat. No. 4,714,082 issued on Dec. 22, 1987 to Chandra K. Banerjee, et al.; U.S. Pat. No. 4,715,389 issued on Dec. 29, 1987 to Dwo Lynn, et al.; and U.S. Pat. No. 4,732,168 issued on Mar. 22, 1988 to James L. Resce, et al.

In U.S. Pat. Nos. 3,356,094; 4,340,072 and 4,732,168, smoke from the burning tobacco is mixed with the aerosol and delivered to the smoker's mouth. In U.S. Pat. No. 715,389, a tobacco column has a central channel which holds a plug of carbonized tobacco with plugs of aluminum screen to both sides of the tobacco plug. Both smoke from the tobacco column and pyrolyzed products of the carbonized tobacco plug are delivered to the smoker's mouth. In U.S. Pat. No. 3,258,015, the aerosol from a nicotine-releasing composition located within a central tube passes through a nucleating chamber wherein the aerosol is cooled and condensed to droplets before being discharged to the smoker's mouth.

SUMMARY OF THE INVENTION

The present invention provides a smoking device having a central tube of an impermeable material located within a tobacco column, wherein the central tube contains a heat absorbing, porous non-tobacco substrate including a flavor releasing material which is more straightforward in construction than the similar known smoking devices.

The present invention further provides a smoking device of the class described wherein smoke from the burning tobacco column does not enter the smoker's mouth.

The present invention also provides a smoking device of the class described which does not require a nucleating chamber for the aerosol generated in the central tube.

More particularly, the present invention provides a smoking device having a tobacco column with a central tube disposed therein, the central tube being fabricated of a paper material which is impermeable to smoke and which is friable at the smoldering temperature of the tobacco of the tobacco column; a heat absorbing substrate of porous non-tobacco material disposed within the tube; a flavor releasing material mixed with the porous substrate, which flavor is volatile at the smoldering temperature of the tobacco of the tobacco column; an aerosol generating material impregnating the porous substrate and being aerosolized by the heat generated by the smoldering tobacco; a mouthpiece which may or may not include a filter coaxially located at one end of the tobacco column, and sealing means at the interface of the mouthpiece and tobacco column to prevent the passage of smoke from the tobacco column into the mouthpiece.

BRIEF DESCRIPTION OF THE DRAWING

A better understanding of the invention will be had upon reference to the following description in conjunction with the accompanying drawings wherein the numerals refer to like parts throughout the several views and wherein.

DETAILED DESCRIPTION OF THE PREFERRED EMBODIMENTS

Figure 1:
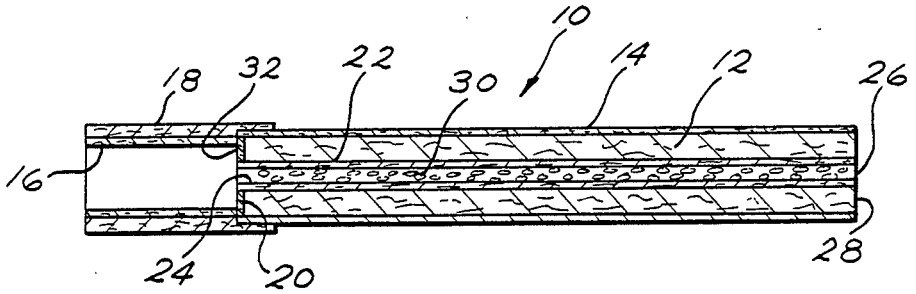
FIG. 1 is a longitudinal cross-sectional view of one embodiment of the present invention.

With reference to FIG. 1, there is shown a smoking device, generally denoted as the numeral 10, of the present invention. The smoking device 10 comprises a generally cylindrical tobacco column 12 circumferentially wrapped with a paper wrapper 14. The paper wrapper 14 is preferably of the type having a controlled burning rate which emits little visible smoke, commonly referred to as sidestream smoke. It is further contemplated that the tobacco column 12 be double wrapped, that is be wrapped with two layers of such wrapper paper. A mouthpiece 16 is located at the outlet end 20 of the tobacco column 12 coaxial with the tobacco column 12 and is connected thereto by a circumscribing tipping material 18 which overlaps the adjacent end of the tobacco column 12. The mouth piece 16 is shown as being a hollow cylindrical structure fabricated of an impermeable material such as a plastic. A rigid paper tube 22 is concentrically located within the tobacco column 12 and extends the entire length of the tobacco column 12 so that the outlet end 24 of the tube 22 is open to the outlet end 20 of the tobacco column 12 and the other, or inlet end 26 of the tube 22 is open to the opposite or front end 28 of the tobacco column 12. The tube 22 is gas impermeable and is friable at the smoldering temperature of the tobacco of the tobacco column 12. The central paper tube can be pretreated with a burn retardant such as sodium chloride, magnesium chloride, ammonium sulfamate, sodium borate, or ammonium sulfate. The tube 22 is filled with a substrate of a porous non-tobacco, heat absorbing material such as alumina, charcoal, or vermiculite. In addition, a flavor releasing material is included in the tube 22. The flavor material can be, for example, a flavorful tobacco admixed with the substrate material, or a liquid flavor extract composition impregnating the porous substrate, such as a nicotine extract, which vaporizes at the smoldering temperature of the tobacco of the tobacco column 12. An aerosol generating material, such as glycerine, propylene glycol and mixtures thereof, also impregnating the porous substrate 30 is aerosolized by the heat generated by the smoldering tobacco column. A seal 32, such as an impermeable metal or treated paper ring, is located at the interface of the mouthpiece 16 and the outlet end 20 of the tobacco column 12 to prevent smoke from the smoldering tobacco column 12 from entering the mouthpiece.

Figure 2:
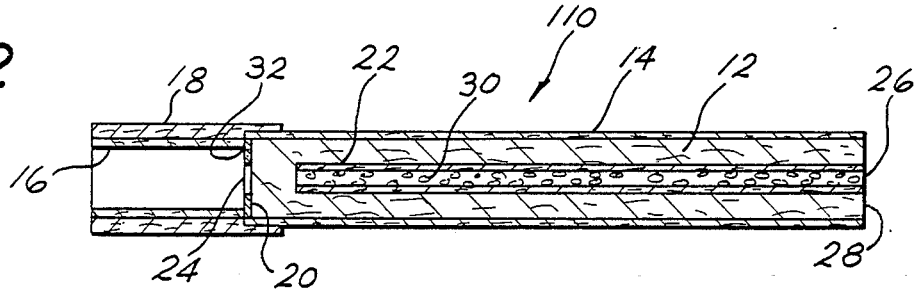
FIG. 2 is a longitudinal cross-sectional view of another embodiment of the present invention.

FIG. 2 illustrates a somewhat different embodiment of the smoking device, generally denoted as the numeral 110, of the present invention which is identical to the smoking device 10 in almost all respects. For the sake of brevity of description, the identical features are identified by identical numerals and their description will not be repeated. The only difference between the smoking device 110 and the smoking device 10 is that in the smoking device 110 the outlet end 24 of the tube 22 terminates a distance of 1–5 mm short of the outlet end 20 of the tobacco column 12.

Figure 3:
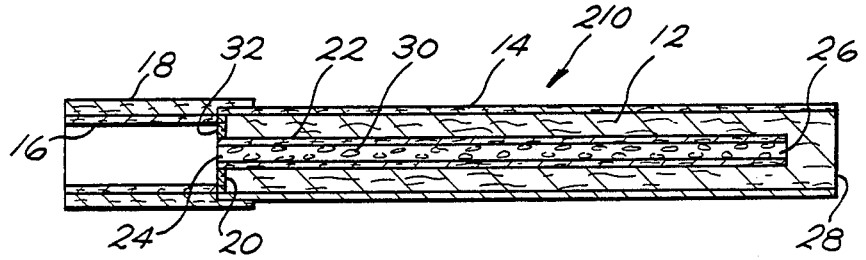
FIG. 3 is a longitudinal cross-sectional view of yet another embodiment of the present invention.

FIG. 3 illustrates a somewhat different embodiment of the smoking device, generally denoted as the numeral 210, of the present invention which is identical to the smoking device 10 in almost all respects. For the sake of brevity of description, the identical features are identified by identical numerals and their description will not be repeated. The only difference between the smoking device 210 and the smoking device 10 is that in the smoking device 210 the inlet end 26 of the tube 22 terminates a distance of 1–5 mm short of the front end 28 of the tobacco column 12. That is, the tube inlet end 26 is spaced a distance from the tobacco column front end 28 inside the tobacco column 12 such that the inlet tube end 26 is initially covered or closed by tobacco of the tobacco column 12. The result is that upon initial ignition of the tobacco column 12 at the front end 28, air drawn into the tube 22 through the tube inlet end 26 passes through the smoldering tobacco coal to induce air flow which aids lighting the smoking device.

Figure 4:
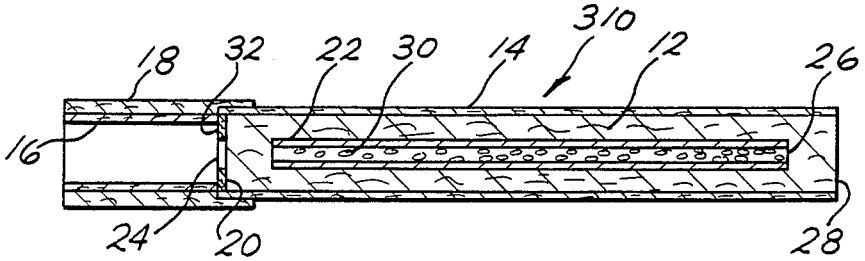
FIG. 4 is a longitudinal cross-sectional view of yet a further embodiment of the present invention.

FIG. 4 illustrates a somewhat different embodiment of the smoking device, generally denoted as the numeral 310, of the present invention which is identical to the smoking device 210 in most respects. The only difference between the smoking device 310 and the smoking device 210 is that in the smoking device 310 the outlet end 24 of the tube 22 terminates a distance of 1–5 mm short of the outlet end 20 of the tobacco column 12 in addition to the tube inlet end 26 of the tube 22 terminating a distance of 1–5 mm short of the front end 28 of the tobacco column 12.

Figure 5:
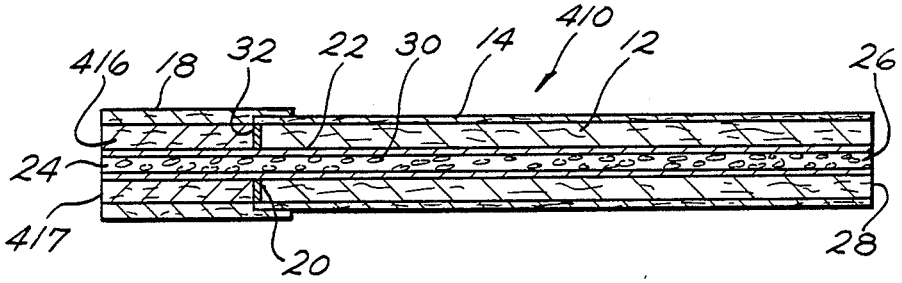
FIG. 5 is a longitudinal cross-sectional view of a still further embodiment of the present invention.

FIG. 5 illustrates yet another embodiment of the smoking device, generally denoted as the numeral 410, of the present invention which is identical to the smoking device 10 in most respects. For the sake of brevity of the description, the identical features are identified by identical numerals and their description will not be repeated. In the smoking device 410, the hollow cylindrical mouthpiece of the smoking device 10 has been replaced by a filter mouthpiece 416 fabricated of, for example, fibrous cellulose acetate. Also, in the smoking device 410, the tube 22 extends completely through the filter mouthpiece 416 so that the tube outlet end 24 is open to the outlet end 417 of the filter mouthpiece 416. With the use of a filter mouthpiece 416, the seal 32 can be created by treating the filter material of the filter mouthpiece 416 at the interface with the tobacco column 12 with a material which will close the pores or openings of the filter mouthpiece.

Figure 6:
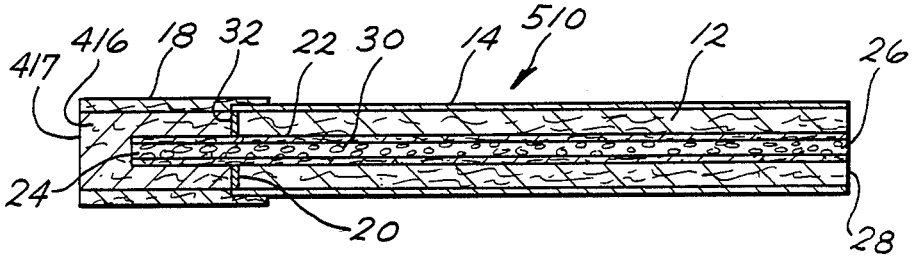
FIG. 6 is a longitudinal cross-sectional view of even still a further embodiment of the present invention.

FIG. 6 illustrates yet a further embodiment of the smoking device, generally denoted as the numeral 510, of the present invention which is virtually identical to the smoking device 410. For the sake of brevity of the description, the identical features are identified by identical numerals and their description will not be repeated. The only difference between the smoking device 510 and the smoking device 410 is that in the smoking device 510, the outlet end 24 of the tube 22 terminates a distance short of the outlet end 417 of the filter mouthpiece 416. That is, the tube outlet end 24 is spaced a distance from the filter mouthpiece outlet end 417 inside the filter mouthpiece 416 such that the tube outlet end 24 is covered by filter material of the filter mouthpiece 416.

Figure 7:
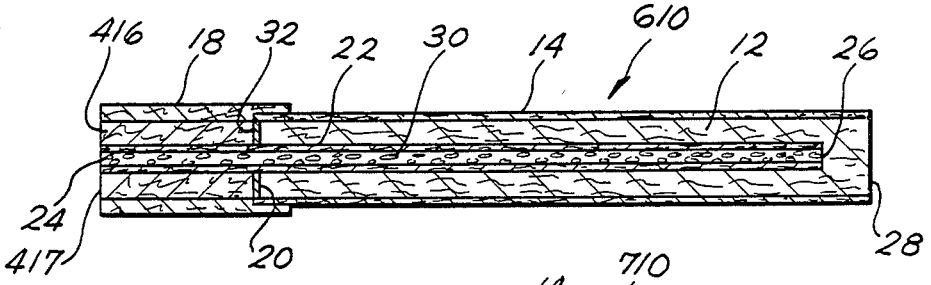
FIG. 7 is a longitudinal cross-sectional view of a further embodiment of the present invention.

FIG. 7 illustrates a still further embodiment of the smoking device, generally devoted as the numeral 610, of the present invention which is also substantially identical to the smoking article 410. For the sake of brevity of the description, the identical features are designated by identical numerals and, therefore, their description will not be repeated. The difference between the smoking device 610 and the smoking device 410 is that in the smoking device 610 the inlet end 26 of the tube 22 terminates a distance short of the front end 28 of the tobacco column 12. That is, the tube inlet end 26 is spaced a distance from the tobacco column front end 28 inside the tobacco column 12 such that the tube inlet end 26 is initially covered or closed by tobacco of the tobacco column 12.

Figure 8:
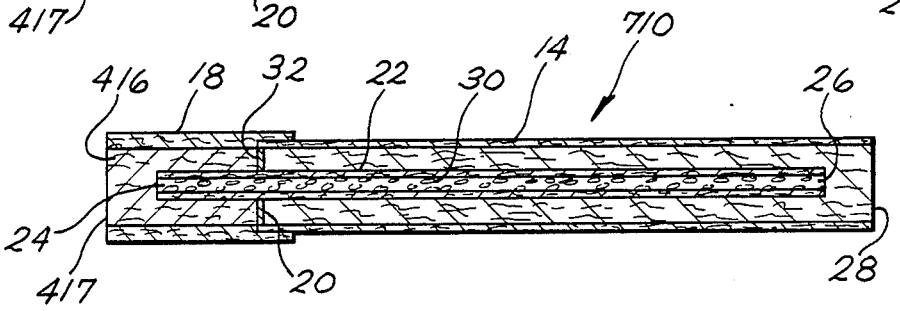
FIG. 8 is also a longitudinal cross-sectional view of a further embodiment of the present invention.

Turning now to FIG. 8, there is shown yet another embodiment of the smoking device, generally denoted as the numeral 710, of the present invention which is also similar to the smoking device 410 in most respects. Therefore, for the sake of brevity of the description, identical features are denoted by identical numerals and their description will not be repeated. The differences between the smoking device 710 and the smoking device 410 are that in the smoking device 710, the outlet end 24 of the tube 22 terminates a distance short of the outlet end 417 of the filter mouthpiece 416, and the inlet end 26 of the tube 22 terminates a distance short of the front end 28 of the tobacco column 12. Therefore, the tube outlet end 24 is spaced a distance from the filter mouthpiece outlet end 417 inside the filter mouthpiece 416 such that the tube outlet end 24 is covered or closed by filter material of the filter mouthpiece 416, and also the tube inlet end 26 is spaced a distance from the tobacco column front end 28 inside the tobacco column 12 such that the tube inlet end 26 is initially covered or closed by tobacco of the tobacco column 12.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A smoking device comprising:

a tobacco column as the heat source for the smoking device when ignited;

a wrapper circumscribing the tobacco column;

a mouthpiece located at one end of the tobacco column coaxially therewith and connected thereto;

a rigid tube concentrically located within the tobacco column, the tube being fabricated of paper material which is gas impermeable and which is friable at the smoldering temperature of the tobacco of the tobacco column;

a substrate of heat absorbing porous non-tobacco materials disposed within the rigid tube;

a flavor releasing material mixed with the porous substrate, the flavor releasing material being volatile at the smoldering temperature of the tobacco of the tobacco column;

an aerosol generating material impregnating the porous substrate, the aerosol generating material being aerosolized by the heat generated by the smoldering tobacco column; and, sealing means at the interface of the mouthpiece and tobacco column for preventing the passage of smoke from the tobacco column into the mouthpiece.

2. The smoking device of claim 1, wherein the rigid tube terminates a distance short of the end of the tobacco column opposite the end thereof having the mouthpiece.

3. The smoking device of claim 2, wherein the rigid tube terminates about 1 to 5 mm from the end of the tobacco column.

4. The smoking device of claim 1, wherein the rigid tube extends the total length of the tobacco column and is open to both ends of the tobacco column.

5. The smoking device of claim 1, wherein the rigid tube terminates a distance short of the end of the tobacco column at which the mouthpiece is located.

6. The smoking device of claim 5, wherein the rigid tube terminates about 5–15 mm from the end of the tobacco column having the mouthpiece.

7. The smoking device of claim 1, wherein the rigid tube terminates a distance short of the end of the tobacco column at which the mouthpiece is located and terminates a distance short of the end of the tobacco column opposite the end thereof having the mouthpiece.

8. The smoking device of claim 1, wherein the rigid tube is treated with a burn retardant material.

9. The smoking device of claim 8, wherein the burn retardant material is selected from the group consisting of sodium chloride, magnesium chloride, sodium borate, ammonium sulfamate, and ammonium sulfate.

10. The smoking device of claim 1, wherein:

the mouthpiece is a filter rod; and, the rigid tube extends through the tobacco column and through the filter rod such that the tube is open to the end of the tobacco rod opposite the filter rod, and also open to the outlet end of the filter rod.

11. The smoking device of claim 1, wherein:

the mouthpiece is a filter rod; and, the rigid tube extends in the tobacco column and filter rod such that the tube is open to the end of the tobacco column opposite the filter rod and terminates a distance short of the outlet end of the filter rod.

12. The smoking device of claim 1, wherein:

the mouthpiece is a filter rod; and, the rigid tube extends in the tobacco column and filter rod such that the tube terminates a distance short of the end of the tobacco column opposite the filter rod, and is open at its other end to the outlet end of the filter rod.

13. The smoking device of claim 1, wherein:

the mouthpiece is a filter rod; and, the rigid tube extends in the tobacco column and filter rod such that the tube terminates a distance short of the end of the tobacco column opposite the filter rod and also terminates a distance short of the outlet end of the filter rod.

* * * * *